US006553974B1

(12) United States Patent
Wickman et al.

(10) Patent No.: US 6,553,974 B1
(45) Date of Patent: Apr. 29, 2003

(54) ENGINE FUEL SYSTEM WITH A FUEL VAPOR SEPARATOR AND A FUEL VAPOR VENT CANISTER

(75) Inventors: Timothy P. Wickman, Fond du Lac, WI (US); David C. Entringer, Wautoma, WI (US); Brian L. Merten, Mt. Calvary, WI (US); DuWayne C. Schelter, Waupun, WI (US); John M. Rath, Hartford, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/001,401

(22) Filed: Oct. 24, 2001

(51) Int. Cl.[7] ..... F02M 37/04
(52) U.S. Cl. ..... 123/516; 123/518
(58) Field of Search ..... 123/516, 518, 123/519, 520, 521, 198 D; 340/984; 220/86.1, 86.2

(56) References Cited

U.S. PATENT DOCUMENTS 3,709,202 A * 1/1973 Brown ..... 123/73 R
3,917,109 A 11/1975 MacDonald ..... 220/85
5,103,793 A 4/1992 Riese et al. ..... 123/516
5,203,306 A 4/1993 Billingsley et al. ..... 123/518
5,229,766 A 7/1993 Hargest ..... 340/984
5,372,116 A * 12/1994 Davis ..... 123/516
5,579,740 A 12/1996 Cotton et al. ..... 123/516
5,881,698 A * 3/1999 Tuckey et al. ..... 123/497
6,009,859 A * 1/2000 Roche et al. ..... 123/509
6,149,477 A * 11/2000 Toyama ..... 440/88
6,331,127 B1 * 12/2001 Suzuki ..... 440/88

* cited by examiner

*Primary Examiner*—Carl S. Miller
(74) *Attorney, Agent, or Firm*—William D. Lanyi

(57) ABSTRACT

A fuel supply system for a marine engine provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber. In addition, a sensor is provided to provide a signal that represents a condition in which liquid fuel within the additional fuel chamber exceeds a predetermined level.

20 Claims, 5 Drawing Sheets

ENGINE FUEL SYSTEM WITH A FUEL VAPOR SEPARATOR AND A FUEL VAPOR VENT CANISTER

BACKGROUND OF THE INVENTION

1. Field of the Invention

The present invention is generally related to an internal combustion engine fuel system and, more particularly, to a fuel system that has a fuel vapor separator which is vented to a separate container for preventing fuel spillage.

2. Description of the Prior Art

U.S. Pat. No. 5,103,793, which issued to Riese et al on Apr. 14, 1992, discloses a vapor separator for an internal combustion engine. The vapor separator assembly for an internal combustion engine includes a bowl member and a cover member. A fuel pump is located in the internal cavity of the bowl member and has an inlet located in the lower portion of the bowl cavity, for supplying fuel thereto. The, fuel pump is secured in position within the bowl member by engagement of the cover member with the fuel pump. The cover member includes a mounting portion for mounting a water separating filter element to the vapor separator assembly. The cover member includes structure for routing fuel from the discharge of the water separating filter element to the interior of the bowl member internal cavity. A compact arrangement is thus provided for the vapor separator, the fuel pump and the water separating filter, eliminating a number of hose connections between such components as well as facilitating assembly to the engine.

U.S. Pat. No. 5,203,306, which issued to Billingsley et al on Apr. 20, 1993, describes a fuel feed system for an internal combustion engine. The system includes a fuel pump, a vapor separator including a fuel chamber having an inlet and an outlet and being adapted to contain a supply of fuel, the vapor separator including a float valve and a passage for venting fuel vapor from the chamber when the supply of fuel is below a predetermined level, and a vapor pump communicating with the passage and a source of cyclically varying pressure for pumping fuel vapor from the vapor separator and to a location remote from the source of alternating pressure, the fuel vapor pump operating independently of the fuel pump.

U.S. Pat. No. 5,579,740, which issued to Cotton et al on Dec. 3, 1996, describes a fuel handling system for an internal combustion engine having a vapor separator for receiving fuel from a remote tank and a pump for delivering the fuel under high pressure to a fuel injector of the engine while providing vapor separation. The separator has an inlet for receiving fuel from the tank, an outlet for enabling fuel to be removed and delivered to the engine, at least one return for enabling fuel not used by the engine to be returned to the separator, and a vent for removing fuel vapor from a gas dome above a pool of liquid fuel within the separator. The inlet has a valve controlled by a float in the reservoir for admitting fuel to maintain the level of liquid fuel in the separator. To retard foaming and excessive vaporization of liquid fuel in the separator, the separator has a perforate baffle between any return and the liquid fuel pool. To prevent any stream of returned fuel, vapor and/or air from impinging against the fuel pool, the baffle preferably has a plurality of through openings which enable liquid fuel to pass through the baffle to the pool while deflecting any return stream away from the fuel pool. The baffle preferably extends outwardly to the separator sidewall for preventing any return stream from passing around the baffle and directly impinging against the liquid fuel while at least slightly pressurizing gas below the baffle for controlling vapor venting to the engine.

U.S. Pat. No. 5,229,766, which issued to Hargest on Jul. 20, 1993, describes a marine fuel tank pollution control apparatus. A marine craft includes a pollution control device for marine fuel tanks. The pollution control device includes a compartment for receiving fuel that leaves the fuel tank headed toward the vent via the vent line. The volume of the compartment desirably holds more fuel than would be contained in the volume of the length of the vent line that extends from the fuel tank to the vent. The compartment has an inlet that communicates with the fuel tank via the vent line. The compartment has an outlet that communicates with the vent via the vent line. The device includes a guide tube disposed within the compartment for preventing direct transmission of fuel to the vent. The device includes a float member disposed within the guide tube for detecting fuel in the vent line. The device includes an alarm circuit activated when the float member is located at a predetermined position within the guide tube. The device includes a lifting arm connected to the float member and enabling the float member to be lifted to a position where the operative alarm circuit should activate a signal.

U.S. Pat. No. 3,917,109, which issued to MacDonald on Nov. 4, 1975, describes an evaporative emission control system. A domed fuel tank carries a vapor-liquid separator in the domed portion with a single vent conduit extending from the vapor-liquid separator to the exterior of the tank.

The patents described above are hereby expressly incorporated by reference in the description of the present invention.

SUMMARY OF THE INVENTION

A fuel supply for a marine propulsion device made in accordance with the preferred embodiment of the present invention, comprises an engine having a crankshaft supported by the engine for rotation about a generally vertical axis. It also comprises a first fuel chamber having a first inlet conduit to receive liquid fuel from a fuel storage tank. A first outlet conduit is connected in fluid communication with the engine and a first vent is provided for allowing fuel vapors to flow out of the first fuel chamber.

A second fuel chamber has a second inlet conduit connected to the first vent of the first fuel chamber. The second fuel chamber also has a second vent for allowing fuel vapors to flow out of the second fuel chamber.

A valve, disposed within the second fuel chamber, is associated with the second vent for blocking the second vent when liquid fuel within the second fuel chamber exceeds a first predetermined amount. A sensor, disposed within the second fuel chamber, has an output signal which is representative of a condition in which the liquid fuel within the second fuel chamber exceeds a second predetermined amount. The first and second predetermined amounts can be the same amount in certain embodiments of the present invention.

The fuel system of the present invention can further comprise a first fuel pump for drawing liquid fuel from the fuel storage tank and for pumping the liquid fuel into the first fuel chamber. It can also comprise a second fuel pump for drawing fuel from the first fuel chamber and pumping the liquid fuel to the engine. In certain embodiments of the present invention, the; fuel system further comprises a fuel injector connected in fluid communication with the first fuel chamber and with the engine.

The valve of the present invention can comprise a float which is less dense than liquid fuel. The valve can also comprise a rounded surface which is movable into blocking association with the second vent in response to the liquid fuel within the second fuel chamber exceeding the first predetermined amount. Alternatively, a solenoid can be used to force a blocking element, such as the rounded or conical surface into blocking association with the vent. The second vent can be open to the atmosphere for allowing fuel vapors to flow out of the second fuel chamber.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
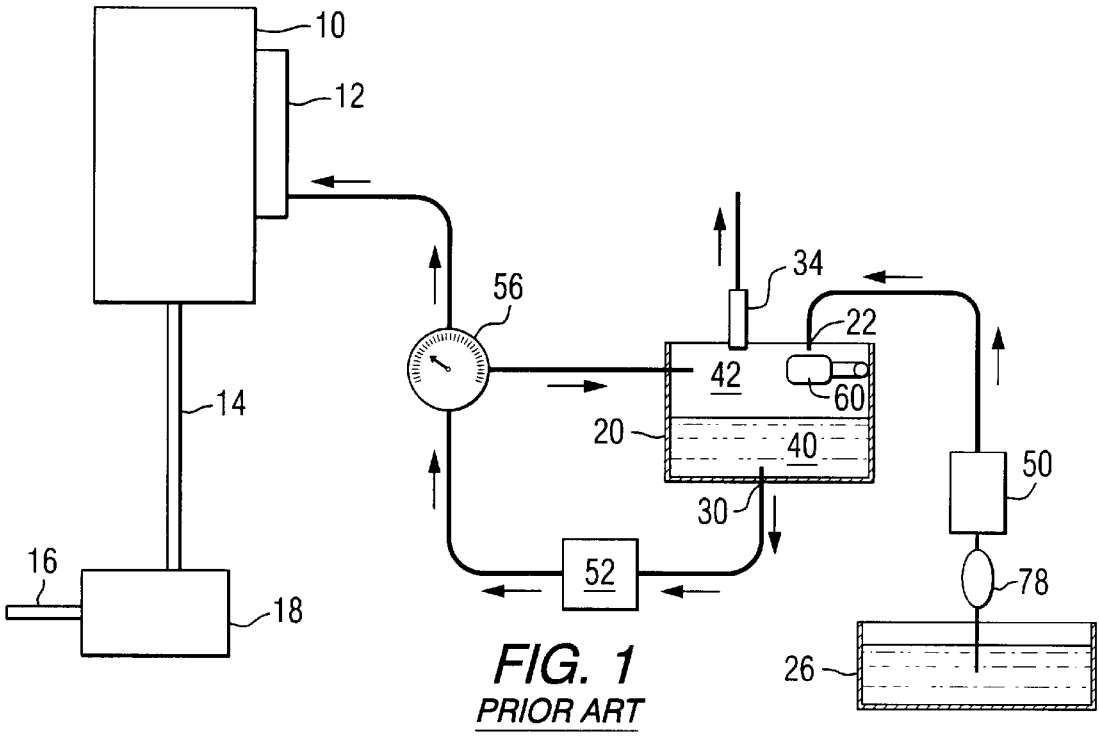
FIG. 1 PRIOR ART
FIGS. 1 and 2 show two fuel systems known to those skilled in the art.

Throughout the description of the preferred embodiment of the present invention, like components will be identified by like reference numerals.

Figure 2:
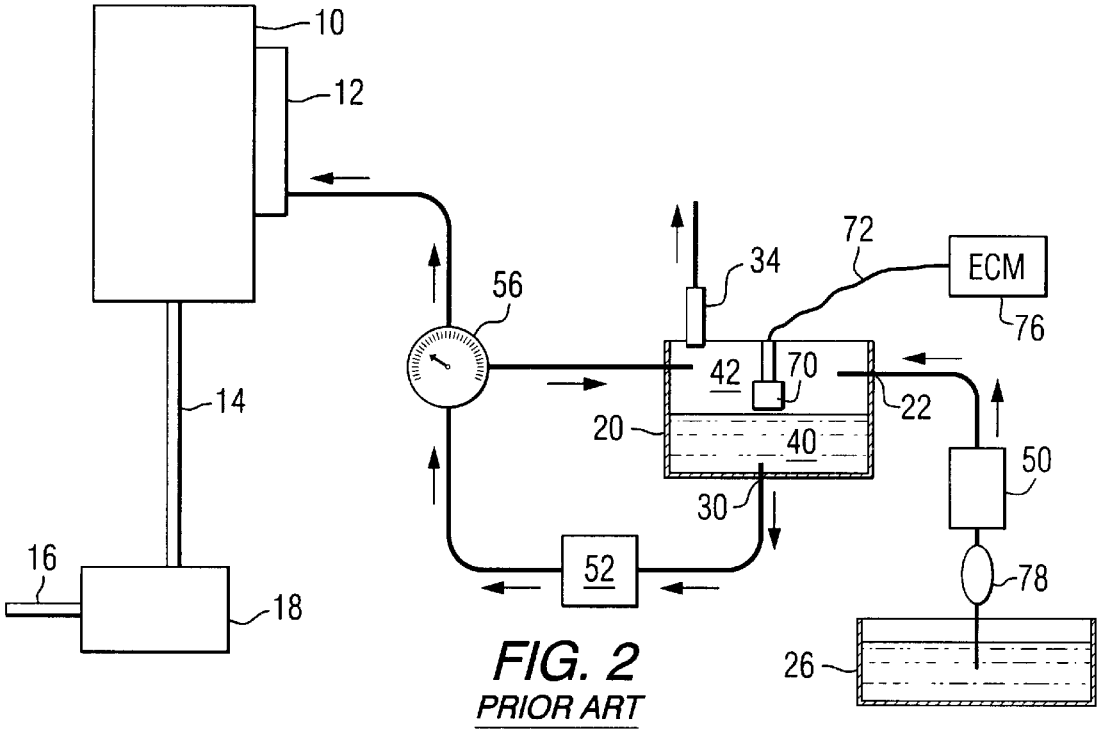
FIG. 2 PRIOR ART

FIGS. 1 and 2 represent two fuel system configurations that are well known to those skilled in the art. Both of these figures are highly schematic and intended to show the basic association and connection between various components of the fuel system.

At the left side of FIGS. 1 and 2, an engine 10 is shown with a fuel rail 12 that supplies fuel to one or more fuel injectors. The fuel injectors, not shown in FIGS. 1 and 2, are disposed partly within the engine 10 and partly within the fuel rail 12. The engine 10 supports a vertically disposed crankshaft within its structure. An output shaft 14 extends from the engine 10 for rotation about generally vertical axis and is connected in torque transmitting communication with a propeller shaft 16, through an appropriate set of gears that are schematically represented by the box identified by reference numeral 18. A propeller, not shown in FIGS. 1 and 2, is typically attached to the propeller shaft 16 for propelling a marine vessel.

With continued reference to FIGS. 1 and 2, a first fuel chamber 20 serves as a fuel vapor separator and has a first inlet conduit, at location 22, to receive liquid fuel from a fuel storage tank 26. A first outlet conduit, at location 30, is connected in fluid communication with the engine 10 and, more specifically, with is the fuel rail 12 associated with engine 10. A first vent 34 is provided for allowing fuel vapors to flow out of the first fuel chamber 20. Within the first fuel chamber 20, both liquid fuel 40 and fuel vapor 42 are contained within the first fuel chamber 20.

A first fuel pump 50 is provided to draw liquid fuel from the fuel storage tank 26 and pump the fuel into the first fuel chamber 20. A second fuel pump 52 is provided for drawing liquid fuel from the first fuel chamber 20 and pumping the liquid fuel to the engine 10, and more particularly to the fuel rail 12 associated with the engine 10. A pressure regulator 56 is provided to control the pressure of the fuel within the fuel rail 12. Excess fuel is directed by the fuel pressure regulator 56 back to the first fuel chamber 20, as illustrated in FIGS. 1 and 2.

The fuel system shown in FIGS. 1 and 2 differ from each other in the way that they control the level of liquid fuel 40 within the first fuel chamber 20. The system shown in FIG. 1 provides a float 60 that is movable in response to the liquid level of fuel within the first fuel chamber 20. When the float 60 is raised, it blocks the flow of liquid fuel pumped by the first fuel pump 50 from the fuel tank 26. This type of float system is well known to those skilled in the art and normally uses a needle valve or some other device to block the flow of fuel through the first inlet conduit. The upward force on the float 60 by the fuel provides the blocking force of the valve.

The fuel system shown in FIG. 2 provides a sensor 70 which provides a signal, on line 72, to an engine control module 76. The engine control module 76 is normally provided with a switch for controlling the first fuel pump 50 to turn the pump off when the liquid fuel level in the first fuel chamber 20 exceeds a first predetermined amount.

Although the two systems shown in FIGS. 1 and 2 differ in the specific way that they regulate the liquid fuel level within the first fuel chamber 20, they are generally similar in the handling of fuel and, more importantly, in the way they handle the fuel vapor passing through the first vent 34. In FIGS. 1 and 2, a manually controllable primer bulb 78 is normally provided to allow the operator of the marine vessel to manually cause liquid fuel to flow from the fuel storage tank 26 to the first fuel pump 50 in order to prime the first fuel pump 50.

With reference to FIGS. 1 and 2, several problems can occur in conjunction with these fuel systems. For example, the float 60 in FIG. 1 can fail to block the inflow of fuel through the first inlet conduit 22 under the pressure provided by the first fuel pump 50. If the valve function performed by the float 60 fails, the first fuel pump 50 will continue to pump liquid fuel into the first fuel chamber 20 even after the liquid fuel level rises above the first predetermined amount. Eventually, liquid fuel will fill the entire cavity of the first fuel chamber 20 and begin to flow upward and through the first vent 34. This will cause liquid fuel to be spilled into the region surrounding the engine 10. Similarly, if the sensor 70 in FIG. 2 fails to provide the appropriate signal 72 to the engine control module 76, the same situation can occur, with the first fuel chamber 20 being completely filled and with liquid fuel flowing upward and through the first vent 34. In both systems, shown in FIGS. 1 and 2, the primer bulb 78 can be misused by the operator to manually pump excessive liquid fuel from the fuel storage tank 26, through the first fuel pump 50, and into the first fuel chamber 20 until the first fuel chamber is filled and the excess fuel flows upward and through the first vent 34. Any of the circumstances can cause spillage of liquid fuel into the region surrounding the engine 10 and eventually into a body of water in which the marine propulsion system is operated.

Figure 3:
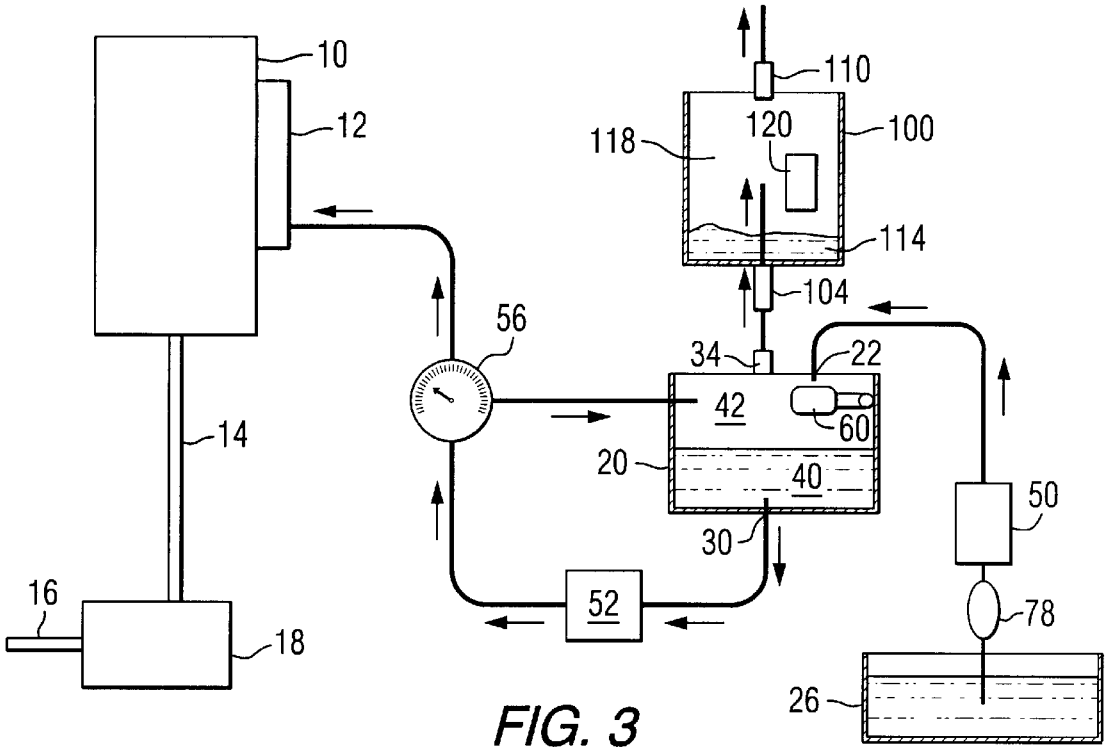
FIG. 3 shows the present invention used in conjunction with a fuel system illustrated in FIG. 1.

FIG. 3 is generally similar to the system in FIG. 1, but with improvements provided by the present invention. A second fuel chamber 100 is provided with a second inlet conduit 104 connected to the first vent 34 of the first fuel chamber 20. The second fuel chamber 100 has a second vent 110 for allowing fuel vapors to flow out of the second fuel chamber 100. Although not illustrated in FIG. 3, the second fuel chamber 100 is provided with a valve associated with the second vent 110 for blocking the second vent when liquid fuel within the second fuel chamber 100 exceeds a first predetermined amount. Although various float elements will be described below in relation to this valve function, it should be understood that an electrically operated solenoid device could be used to force a blocking member, such as a rounded surface, into blocking relation with the second vent 110. Illustrated schematically in FIG. 3, liquid fuel 114 and fuel vapor 118 are contained within the second fuel chamber 100. A sensor 120 is schematically illustrated within the second fuel chamber 100 to provide an output signal which is representative of a condition in which the liquid fuel 114 within the second fuel chamber 100 exceeds, a second predetermined amount. The specific components used to provide the valve within the second chamber and the sensor 120 will be described in greater detail below.

Figure 4:
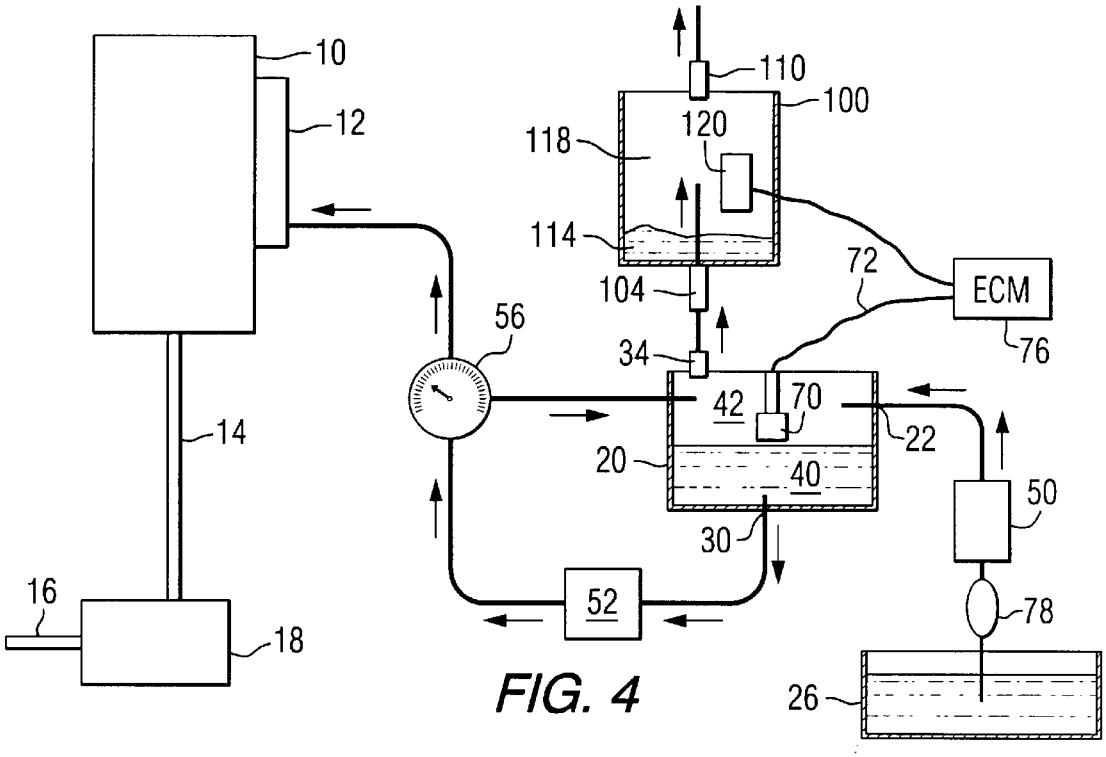
FIG. 4 shows the present invention used in association with a fuel system illustrated in FIG. 2.

FIG. 4 is generally similar to FIG. 2, but with the second fuel chamber 100 of the present invention connected to the first vent 34 of the first fuel chamber 20. The second fuel chamber, as described above, provides a valve within the second fuel chamber 100 to block the second vent 110 when the fuel level rises to a second predetermined amount. The sensor 120, in FIG. 4, is connected to the engine control module 76 in order to allow the engine control module to deactivate the first fuel pump 50 in the event that the liquid fuel 114 rises to a level greater than the second predetermined amount. In FIG. 4, the engine control module 76 is shown receiving signals from the sensor 70 in the first fuel chamber 20 and the sensor 120 in the second fuel chamber 100. If either of the two fuel levels exceed their associated limits, the engine control module 76 can turn off the first fuel pump 50. The blocking feature provided in the second fuel chamber 100 acts as a redundant safety valve in the event that the first fuel chamber 20 is completely filled with liquid fuel 40 and the liquid fuel flows upward through the first vent 34.

Figure 5:
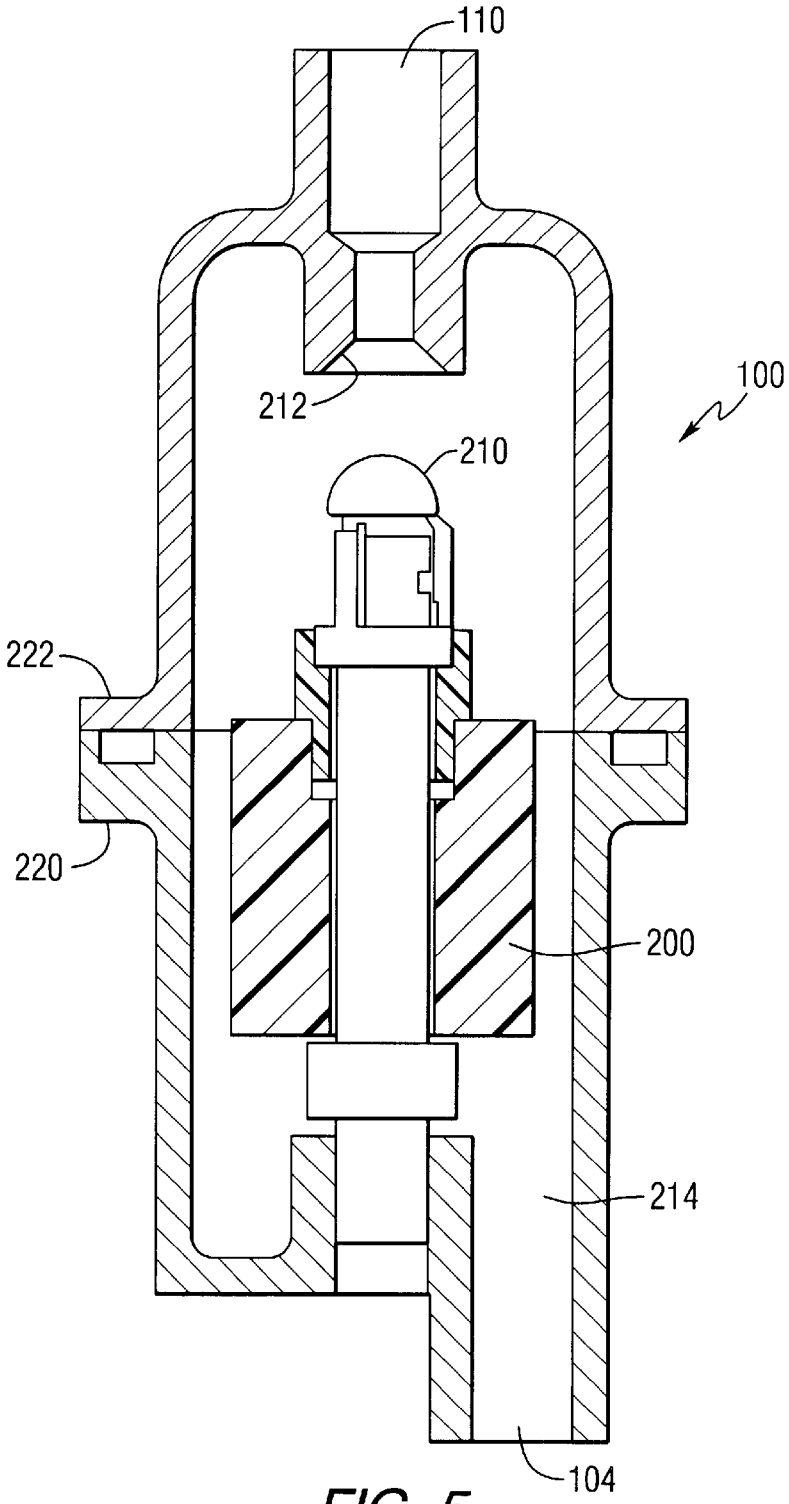
FIG. 5 is a section view of a fuel chamber used in a preferred embodiment of the present invention.

FIG. 5 shows a preferred embodiment of the second fuel chamber 100. The valve function performed by the second fuel chamber 100 comprises a float member 200 and a rounded surface 210. Although a hemispherical surface is described in conjunction with the preferred embodiment of the present invention, it should be understood that other shapes, such as a cone or a frustum of a cone, could be used within the scope of the present invention.

When the bottom portion 214 of the cavity within the second fuel chamber 100 fills with liquid fuel, the float 200 rises and raises the rounded surface 210 toward the generally conical surface 212 of the second vent 110. When the rounded surface 210 moves into contact with the conical surface 212, it blocks the second vent 110 to prevent the flow of liquid fuel through the second vent 110. Although not shown, a filter and condensing mesh can be provided in the bottom portion of the second fuel chamber 100 to condense the fuel vapors.

With continued reference to FIG. 5, it can be seen that the second fuel chamber 100 comprises a lower portion 220 and an upper portion 222 which, when attached together, provide the internal cavity of the second fuel chamber 110. Although not shown in FIG. 5, the float 200 can be provided with a small permanent magnet that is movable relative to a magnetically sensitive component, such as a reed switch or Hall element device. This can be used to provide the sensor 120 described above. The magnetically sensitive component can provide the signal to the engine control module 76 as represented in FIG. 4.

Figure 6:
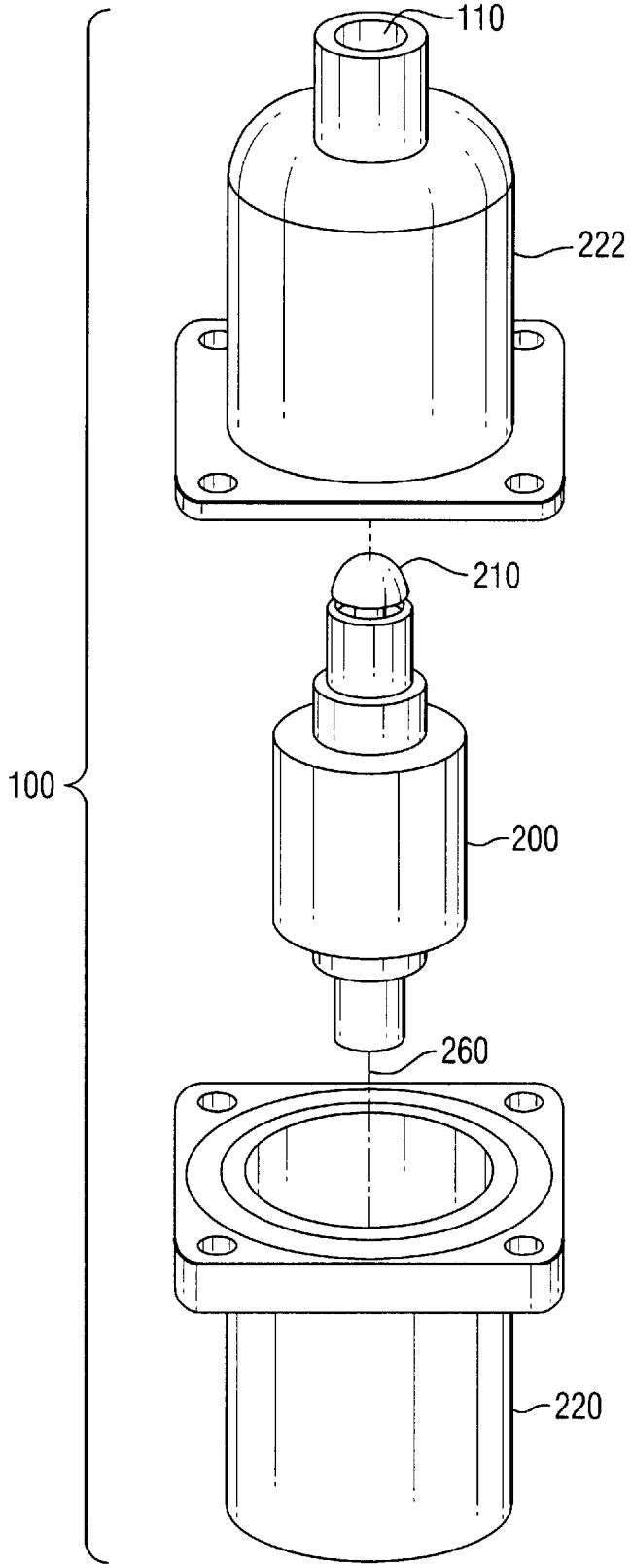
FIG. 6 is an isometric exploded view of the fuel chamber shown in FIG. 5.

FIG. 6 is an exploded isometric view of the second fuel chamber 100. The rounded surface 210 is movable along a generally vertical axis 260 with the float 200 which is responsive to the amount of liquid fuel within the bottom portion 214 of the second fuel chamber. The upper portion 222 of the housing is attachable to the lower portion 220 and the second vent 110 extends upwardly from the upper portion 222.

Figure 7:
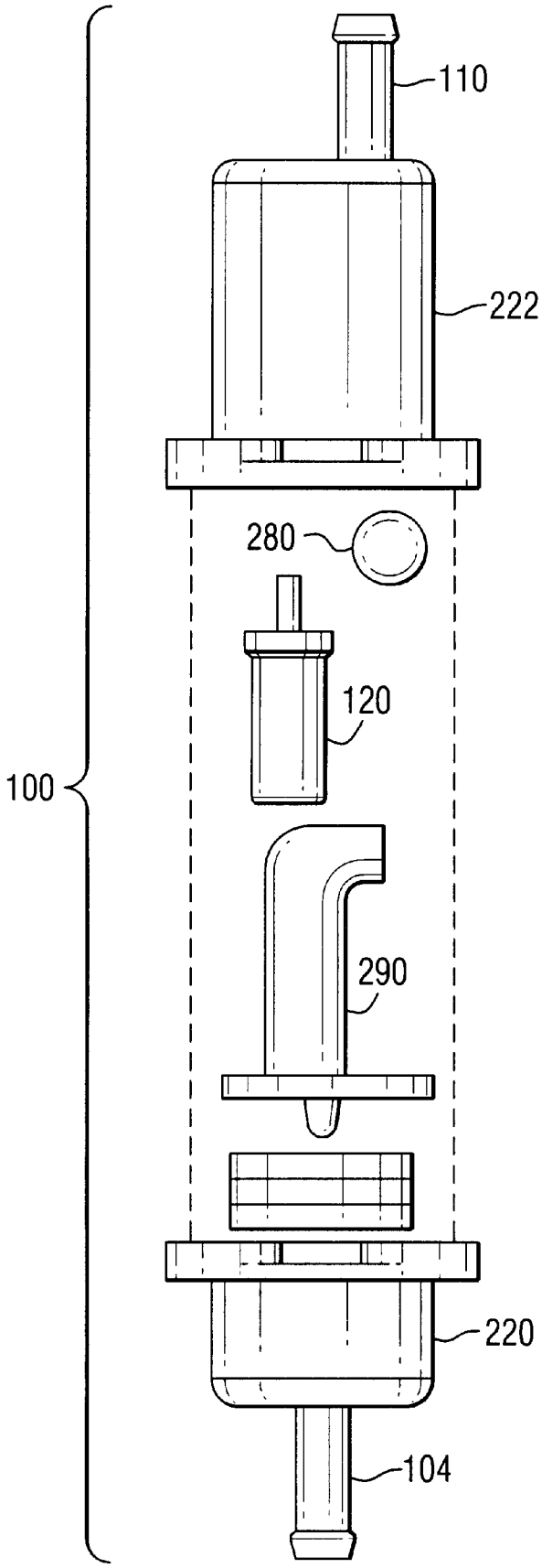
FIG. 7 is an exploded view of an alternate embodiment of the fuel chamber of the present invention.

FIG. 7 shows an alternative embodiment of the present invention. The second fuel chamber is formed by a lower housing 220 and an upper housing 222 which are attachable to each other to form the enclosed cavity described above. Within the cavity, the valve function is, provided by a low density sphere 280 which serves the dual purpose of providing both the float function and the rounded surface 210 described above in conjunction with FIG. 6. When liquid fuel flows into the second fuel chamber 100 to a sufficient level to rise the sphere 280, the sphere moves into blocking association with the second vent 110 and provides a safety redundancy to the other components of the fuel system intended to prevent spillage of liquid fuel. An internal structure 290 is provided within the internal cavity of the second fuel chamber to maintain the sphere 280 in a position near the internal opening of the second vent 110. It also performs the function of providing a space in which the sensor 120 is disposed. The support structure 290 serves an important function in preventing any fuel vapors flowing into the second fuel chamber 100 through the second inlet 104 from causing the sphere 280 to move upward prior to the liquid level within the second fuel chamber 100 rising. Since the sphere 280 is intentionally made of a material having a very low density, the light weight of the sphere 280 can possibly be affected by vapor currents flowing between the second inlet 104 and the second vent 110 even though the liquid level may not be sufficiently high to raise the sphere 280. These fluid flows are directed away from the sphere 280 by the internal structure 290 to prevent this from occurring.

In its various embodiments, a fuel supply system for a marine propulsion device made in accordance with the present invention provides an engine 10 with a crankshaft supported by the engine 10 for rotation about a generally vertical axis. A first fuel chamber 20 having a first inlet conduit 22 to receive liquid fuel from a full fuel storage tank 26 also has a first outlet conduit 30 connected in fluid communication with the engine 10 and, more particularly, with a fuel rail 12 associated with the engine 10. A first vent 34 is provided for allowing fuel vapors to flow out of the first fuel chamber 20. The invention also comprises a second fuel chamber 100 having a second inlet conduit 104 connected to the first vent 34 of the first fuel chamber 20. The second fuel chamber 100 has a second vent 110 for allowing fuel vapors to flow out of the second fuel chamber. A valve, 210 or 280, is associated with the second vent 110 for blocking the second vent when liquid fuel within the second fuel chamber 100 exceeds a first predetermined amount. A sensor 20 is disposed within the second fuel chamber 100 and has an output signal which is representative of a condition in which the liquid fuel within the second fuel chamber 100 exceeds a second predetermined amount. A first fuel pump 50 is provided for drawing liquid fuel from the fuel storage tank 26 and pumping the liquid fuel into the first fuel chamber 20. A second fuel pump 52 is provided for drawing fuel from the first fuel chamber 20 and pumping the fuel to the engine 10. A fuel injector is connected in fluid communication with the first fuel chamber 20 and with the engine 10, particularly with its fuel rail 12. The valve comprises a float 200 which is less dense than the liquid fuel stored in the first fuel chamber 20. The valve comprises a rounded surface 210 that is movable into blocking association with the second vent 110 in response to the liquid fuel within the second fuel chamber 100 exceeding the first predetermined amount. The second vent 110 is open to the atmosphere for allowing fuel vapors to flow out of the second fuel chamber 100.

Although the present invention has been described in particular detail and illustrated to show a preferred embodiment, it should be understood that alternative embodiments are, also within its scope.

We claim:

1. A fuel supply system for a marine propulsion device, comprising:

an engine having a crankshaft supported by said engine for rotation about a generally vertical axis;

a first fuel chamber having a first inlet conduit to receive liquid fuel from a fuel storage tank, a first outlet conduit connected in fluid communication with said engine, and a first vent for allowing fuel vapors to flow out of said first fuel chamber;

a second fuel chamber having a second inlet conduit connected to said first vent of said first fuel chamber, said second fuel chamber having a second vent for allowing fuel vapors to flow out of said second fuel chamber; and a valve, associated with said second vent, for blocking said second vent when liquid fuel within said second fuel chamber exceeds a first predetermined amount.

2. The fuel supply system of claim 1, further comprising:

a sensor disposed within said second fuel chamber, said sensor having an output signal which is representative a condition in which said liquid fuel within said second fuel chamber exceeds a second predetermined amount.

3. The fuel supply system of claim 1, further comprising:

a first fuel pump for drawing liquid fuel from said fuel storage tank and pumping said liquid fuel into said first fuel chamber.

4. The fuel supply system of claim 3, further comprising:

a second fuel pump for drawing fuel from said first fuel chamber and pumping said liquid fuel to said engine.

5. The fuel supply system of claim 1, further comprising:

a fuel injector connected in fluid communication with said first fuel chamber and with said engine.

6. The fuel supply system of claim 1, wherein:

said valve comprises a float which is less dense than liquid fuel.

7. The fuel supply system of claim 1, wherein:

said valve comprises a rounded surface which is movable into blocking association with said second vent in response to said liquid fuel within said second fuel chamber exceeding said first predetermined amount.

8. The fuel supply system of claim 1, wherein:

said second vent is open to the atmosphere for allowing fuel vapors to flow out of said second fuel chamber.

9. A fuel supply system for a marine propulsion device, comprising:

an engine having a crankshaft supported by said engine for rotation about a generally vertical axis;

a first fuel chamber having a first inlet conduit to receive liquid fuel from a fuel storage tank, a first outlet conduit connected in fluid communication with said engine, and a first vent for allowing fuel vapors to flow out of said first fuel chamber;

a second fuel chamber having a second inlet conduit connected to said first vent of said first fuel chamber, said second fuel chamber having a second vent for allowing fuel vapors to flow out of said second fuel chamber; and a sensor disposed within said second fuel chamber said sensor having an output signal which is representative a condition in which said liquid fuel within said second fuel chamber exceeds a second predetermined amount.

10. The fuel supply system of claim 9, further comprising:

a valve, associated with said second vent, for blocking said second vent when liquid fuel within said second fuel chamber exceeds a first predetermined amount.

11. The fuel supply system of claim 10, further comprising:

a first fuel pump for drawing liquid fuel from said fuel storage tank and pumping said liquid fuel into said first fuel chamber.

12. The fuel supply system of claim 11, further comprising:

a second fuel pump for drawing fuel from said first fuel chamber and pumping said liquid fuel to said engine.

13. The fuel supply system of claim 12, further comprising:

a fuel injector connected in fluid communication with said first fuel chamber and with said engine.

14. The fuel supply system of claim 10, wherein:

said valve comprises a float which is less dense than liquid fuel.

15. The fuel supply system of claim 10, wherein:

said valve comprises a rounded surface which is movable into blocking association with said second vent in response to said liquid fuel within said second fuel chamber exceeding said first predetermined amount.

16. The fuel supply system of claim 15, wherein:

said second vent is open to the atmosphere for allowing fuel vapors to flow out of said second fuel chamber.

17. A fuel supply system for a marine propulsion device, comprising:

an engine having a crankshaft supported by said engine for rotation about a generally vertical axis;

a fuel vapor separator having a first inlet conduit to receive liquid fuel from a fuel storage tank, a first outlet conduit connected in fluid communication with said engine, and a first vent for allowing fuel vapors to flow out of said fuel vapor separator;

a fuel vapor vent canister having a second inlet conduit connected to said first vent of said fuel vapor separator, said fuel vapor vent canister having a second vent for allowing fuel vapors to flow out of said fuel vapor vent canister; and a valve, associated with said second vent, for blocking said second vent when liquid fuel within said fuel vapor vent canister exceeds a first predetermined amount.

18. The fuel supply system of claim 17, further comprising:

a sensor disposed within said fuel vapor vent canister, said sensor having an output signal which is representative a condition in which said liquid fuel within said fuel vapor vent canister exceeds a second predetermined amount.

19. The fuel supply system of claim 18, further comprising:

a first fuel pump for drawing liquid fuel from said fuel storage tank and pumping said liquid fuel into said fuel vapor separator, a second fuel pump for drawing fuel from said fuel vapor separator and pumping said liquid fuel to said engine, a fuel injector connected in fluid communication with said fuel vapor separator and with said engine.

20. The fuel supply system of claim 19, wherein:

said valve comprises a float which is less dense than liquid fuel and a rounded surface which is movable into blocking association with said second vent in response to said liquid fuel within said fuel vapor vent canister exceeding said first predetermined amount.

* * * * *